United States Patent [19]

Steele

[11] 4,414,727

[45] Nov. 15, 1983

[54] KIT FOR CONVERTING A BED INTO A FOUR-POSTER

[75] Inventor: Ronald Steele, Cramlington, England

[73] Assignee: Development & Finance Limited, Isle of Man

[21] Appl. No.: 322,427

[22] Filed: Nov. 18, 1981

[30] Foreign Application Priority Data

Nov. 24, 1980 [GB] United Kingdom ..... 8037634

[51] Int. Cl.[3] ..... B23P 7/00; A61J 19/00; A61F 9/00

[52] U.S. Cl. ..... 29/401.1; 5/285; 5/508; 5/11; 5/10 R

[58] Field of Search ..... 29/401.1; 5/1, 10, 11, 5/285, 508

[56] References Cited

U.S. PATENT DOCUMENTS 3,237,217 3/1966 Desueux ..... 5/362

FOREIGN PATENT DOCUMENTS 1210201 10/1970 United Kingdom .

1506513 4/1978 United Kingdom .

*Primary Examiner*—Francis S. Husar
*Assistant Examiner*—V. K. Rising
*Attorney, Agent, or Firm*—Andrus, Sceales, Starke & Sawall

[57] ABSTRACT

A kit of parts for converting a bed into a four-poster comprises pelmets for securing to the ceiling of the bedroom above and parallel with the sides and end of the bed, corner posts for locating one at each corner of the bed, and four brackets each including a first portion for securing to the pelmets above an associated corner of the bed and a second portion pivotal on the first portion and adapted to receive the upper end of an associated post, resilient means reacting between the second portion of the bracket and said upper end of the post, the post and second portion of the bracket being pivotal together between an operative vertical position with the resilient means urging the lower end of the post against the floor and a non-vertical position permitting insertion or removal of the upper end of the post from the bracket.

7 Claims, 8 Drawing Figures

32
36
40
44
30
34
46
48
12
14
54
20
8

2
42
52
50
38
24
28
50
50
52
38
52
26
52
22
50
14
20
8
2
49

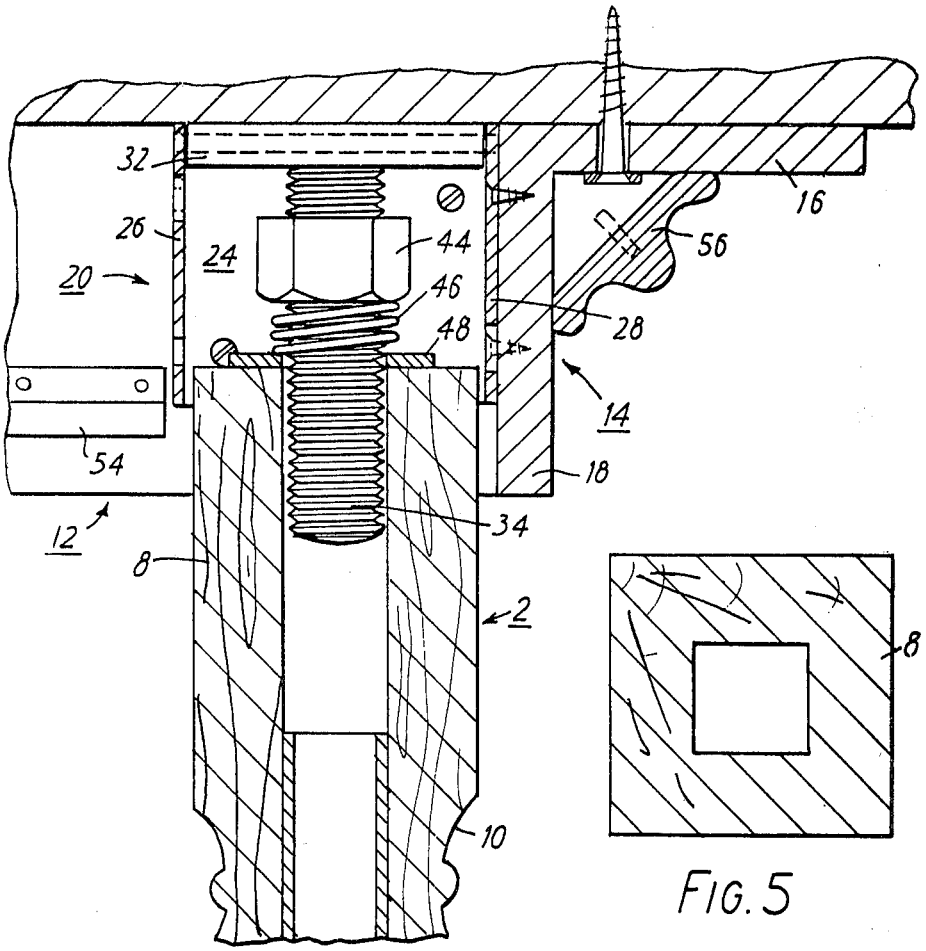
FIG. 4
FIG. 5
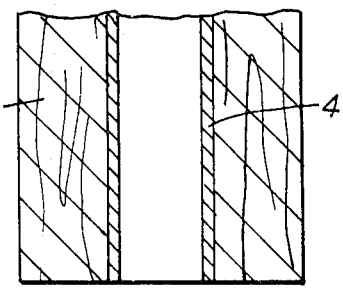
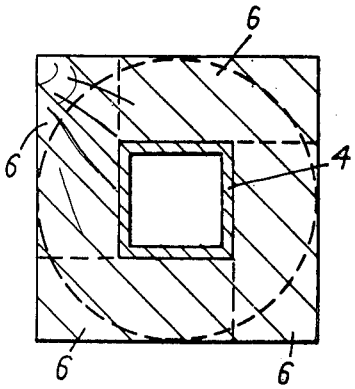
FIG. 6

KIT FOR CONVERTING A BED INTO A FOUR-POSTER

BACKGROUND OF THE INVENTION

This invention relates to a kit of parts for converting a bed, for example a divan bed, into a four-poster.

Established four-posters are commonly of substantial size and very expensive. Accordingly, although four-posters are often desirable to those dwelling in typical domestic residences, the bedrooms of such residences are not big enough to house such beds, while the cost itself is usually prohibitive.

Clearly costs would be substantially reduced if standard sized beds, particularly divans, could be used as the basis for four-posters.

It has been proposed to provide a ground-engaging four-poster framework that can be located to encompass a divan bed to transform said bed into a four-poster bed, for example as disclosed in United Kingdom patent specification No. 1506513.

However, such frameworks are of relatively complex form, incorporating, in addition to the vertical corner posts, a plurality of rails interconnecting adjacent posts, as well as a series of diagonal bars forming a canopy-like top frame to the assembly.

Further, once positioned around a divan bed, such a framework becomes a virtually permanent fixture which cannot be readily moved, other than by complete disassembly, to enable, for example, cleaning in the immediate vicinity, or ready access to the bed.

SUMMARY OF THE INVENTION

According to the present invention there is provided a kit of parts for converting a bed in a bedroom into a four-poster, the kit of parts comprising at least three pelmets for securing to the ceiling of the bedroom, one to extend substantially above and the length of each side of the bed and one to extend substantially above and across the bottom end of the bed, four corner posts, one for each corner of the bed and each of a length just less than the height of the bedroom, and four brackets each including a first portion for securing relative to the ceiling of the bedroom, preferably to the associated pelmet(s), substantially above a corner of the bed, a second portion pivotal relative to said first portion and adapted to receive thereon the upper end of an associated corner post, and resilient means reacting between said bracket and the upper end of the associated corner post to urge the lower end of said post towards the floor of the bedroom.

In use of such a kit, the pelmets are first of all secured to the ceiling to extend parallel with, substantially above the associated side/end of the bed, and the corner brackets are fixed in position substantially above each corner of the bed. The upper ends of the corner posts are then each located in turn on the second portion of the associated bracket with said second portion of the bracket pivoted relative to the first portion in a direction along the length of the bed whereby the corner post and second portion of the bracket make an angle with the vertical. The corner post is pushed slightly upwardly against the resilient means, is pivoted, together with the second portion of the bracket, into a vertical position and is released so that said resilient means urges the lower end of the post into contact with the floor whilst the upper end thereof remains in engagement with the bracket.

Thus it will be appreciated that such a kit enables ready conversion of a standard-sized bed into a four-poster, but has the important advantage that each corner post is independent of the other posts and can be readily removed as required without affecting or involving said other posts. Curtains and/or other trimmings can be suspended from the pelmets.

The second portion of each bracket preferably comprises a top plate and a rod portion fixed to, to extend downwardly from said plate, said rod portion being adapted to be received within a correspondingly shaped axial bore formed in the upper extent of the associated corner post.

Conveniently the second portion of each bracket is pivotal about a substantially horizontal axis extending transversely of the bed.

The resilient means may comprise a coil spring surrounding the rod portion, the upper end of said spring being capable of being fixed relative to the rod portion and the lower end of said spring being adapted for abutment by the upper end of the associated corner post.

In a preferred arrangement, the rod portion is externally threaded and carries thereon a correspondingly threaded nut to which the upper end of the coil spring is attached, while the lower end of the spring carries an annular plate for abutment against the upper end of the associated corner post.

It will thus be appreciated that the position of the spring relative to the bracket can be varied to allow for slight variation in the distance between the floor and the ceiling of a bedroom and whereby the spring can be located to work at optimum efficiency over a given range of said distances.

Each corner post may be of wood, metal, plastics or a combination of these materials, a currently preferred post comprising a metal tube surrounded by an outer wooden sleeve. In such a case, it is preferred that the metal tube terminates short of said upper extent of the post in which is received said rod portion.

If a divan bed to be converted in accordance with the invention is standing in the corner of a bedroom, it will be appreciated that the appropriate kit of parts necessary for said conversion will effectively be that for a 'three-poster' bed in that it can exclude the cornermost post and associated bracket and the pelmet for the side of the bed against the wall.

BRIEF DESCRIPTION OF THE DRAWINGS

FIG. 4 is a vertical section through the part of the kit shown in FIG. 1*b* with the corner post in a vertical position;

FIG. 5 is a top view of the corner post of FIG. 4;

FIG. 6 is a horizontal section through the intermediate extent of the corner post of FIG. 4.

DESCRIPTION OF THE PREFERRED EMBODIMENT

Figures 1A, 1B, 2, 3:
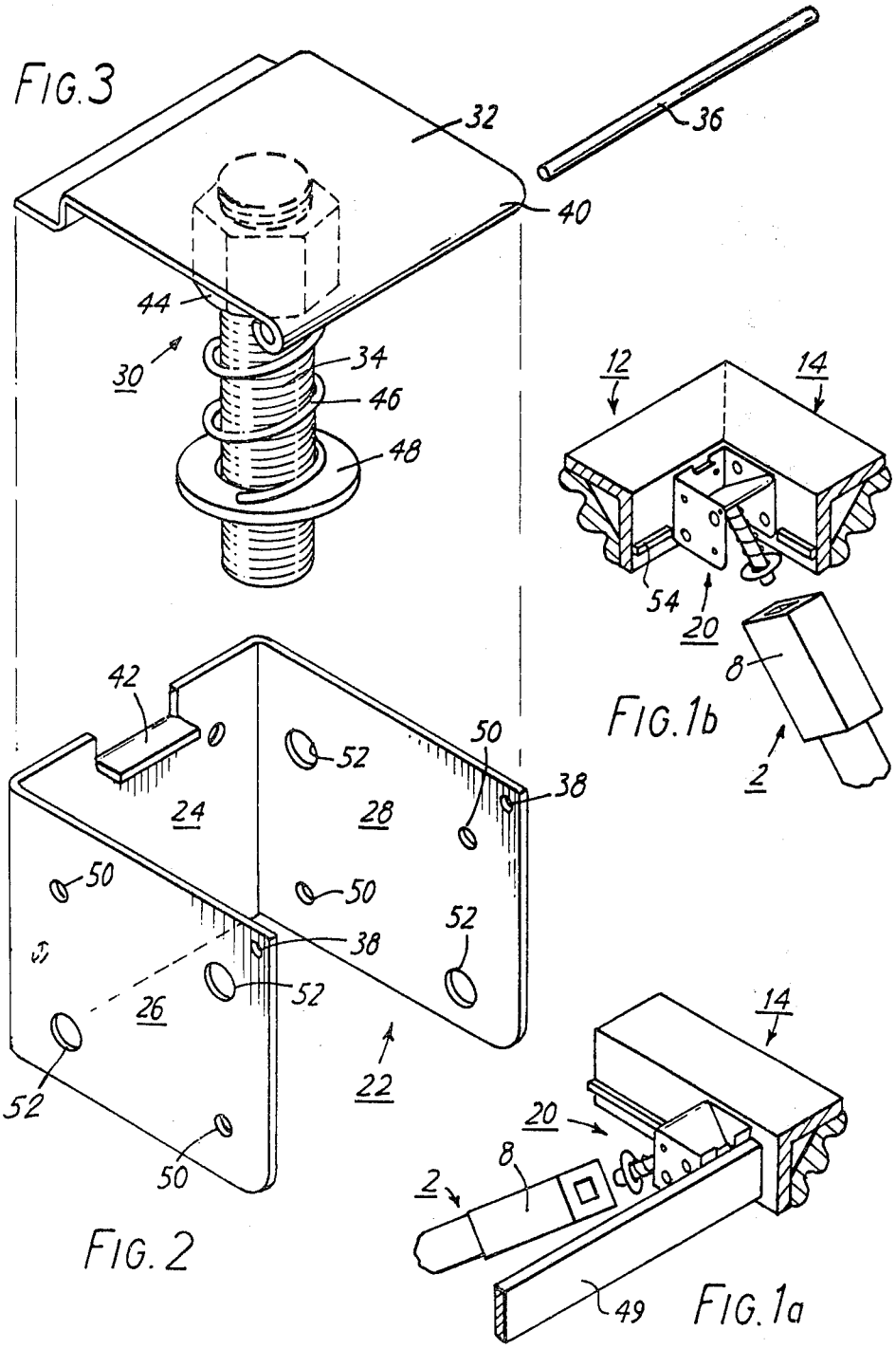
FIGS. 1*a* and 1*b* are perspective views of part of a corner post, pelmets and a bracket of a kit according to the invention for the top and bottom of a divan bed respectively.
FIGS. 2 and 3 show in more detail the first and second portions respectively of the brackets of FIGS. 1*a* and 1*b;*
Figure 7:
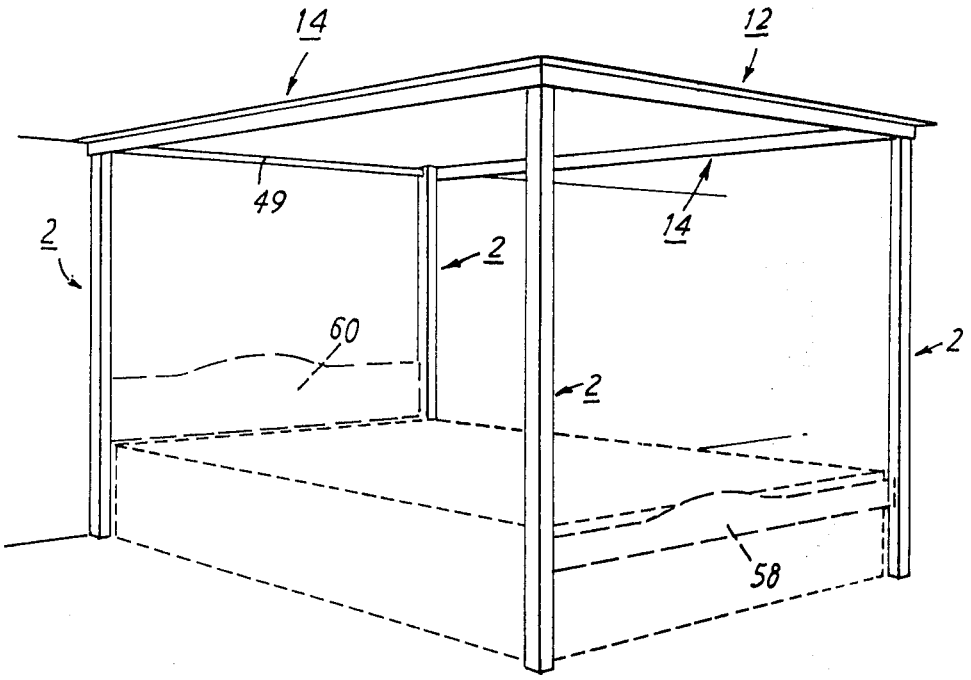
FIG. 7 illustrates a kit according to the invention in assembled form.

Referring to the drawings, the kit comprises four composite corner posts, parts of which are indicated generally at 2 in FIGS. 1*a*, 1*b* and 4, each post being of a length just less than the height of the room in which the resultant four-poster is to be housed for reasons which will become apparent from the following description.

Each post comprises a central metal tube 4, for example of square transverse section, to the faces of which are glued four wooden lengths 6 overlapping each other to constitute a resultant square-section post. The lengths 6 extend upwardly beyond the upper end of the metal tube 4 to provide a hollow, wooden upper extent 8 to the post. The external surface of the post may be turned or shaped, as at 10, or otherwise decorated.

The kit further comprises three wooden pelmets parts of two of which are indicated generally at 12 and 14. Two of the pelmets are of lengths equal to that of the bed converted to a four-poster, while the third pelmet is of a length equal to the width of said bed. Each pelmet is of generally L-shape in transverse section and includes a first flange portion 16 for abutment against and securing to the ceiling of the room and a second flange portion 18 extending vertically downwardly from the portion 16.

The basic kit is completed by four brackets 20, one associated with each of the four corner posts 2. Each bracket 20 consists of a first portion 22 having a back plate 24 and two opposed side plates 26,28 best seen in FIG. 2, and a second portion 30 having a top plate 32 fixed to which is a downwardly extending threaded rod 34 which can be received within the hollow interior of the upper extent 8 of the associated corner post 2.

The second portion 30 is pivotal relative to the first portion 22 about a horizontal axis formed by a pivot pin 36 extending through holes 38 in the side plates 26,28 and a sleeve 40 formed along the front edge of the plate 32.

The second portion 30 of the bracket can pivot relative to the first portion 22 forwardly from a rest position in which the rod 34 is vertical and which is determined by abutment of the rear edge of the plate 32 of the second portion with a horizontal flange 42 formed in the back plate 24 of the first portion 22.

The second portion 30 of each bracket further comprises a threaded nut 44 mounted on the rod 34 and a coil spring 46 surrounding said rod 34. The upper end of the spring 46 is secured to the nut 44 whereby, on rotation of the nut on the rod 34, the spring 46 can be moved axially along said rod. An annular washer 48 is secured to the lower end of the spring 46.

Installation of the kit onto a bed the upper end of which abuts a wall of the bedroom is carried out as follows. The three pelmets are secured to the ceiling of the bedroom above, to extend parallel with but slightly outwardly of, the side edges and bottom end of the bed to be converted, said pelmets typically extending across or parallel with the joists of said ceiling and preferably being screwed to said joists. A bar 49 extends between the ends of the pelmets 14 at the top of the bed.

Of the four corner brackets 20, two are secured, as shown in FIG. 1*b*, to the junctions of the one ends of the side pelmets 14 and the end pelmet 12. More particularly, each of said brackets is screwed to said pelmets by screws extending through holes 50 in the side plates 26 or 28 of the portion 22 and into the rear faces of the flange portions 18 of the pelmets as best seen in FIG. 4. The holes 50 in the side plates 26,28 are such as to enable right- or left-hand fixing of the brackets, while increased diameter holes 52 are formed in the plates 26,28 directly opposite the holes 50 in the plates 28,26 to provide entry for screw-drivers to the opposite plate. The portions 22 are mounted such that, once the portions 30 are attached thereto, the pivot pins 36 extend transversely of the bed and the portions 30 can pivot about said pins 36 in a direction from the bottom of the bed towards the top of the bed.

The remaining two corner brackets are secured, as shown in FIG. 1*a*, again by screws, to the rear faces of the other ends of the two side pelmets 14 and to a face of the cross bar 49. Again the pivot pins 36 of the brackets extend transversely of the bed, the portions 30 of the brackets being pivotal in a direction from the top of the bed towards the bottom thereof.

Each post 2 is then located on its associated bracket 20 by locating the hollow bore of the upper extent 8 over the lower end of the rod 34 with the post and the rod making a small angle with the vertical. The post is then pushed upwardly such that the upper end thereof abuts the lower face of the washer 48, further pushing compressing the spring 46. The post 2 is then pivoted, together with the portion 30 of the bracket, into a vertical position and the post is released whereby the spring 46 urges the post downwardly so that the lower end thereof engages the floor of the room. The length of the post is chosen such that, on contact of the lower end with the floor, the upper end is located as shown in FIG. 4 with the spring 46 only slightly extended from its fully compressed state and therefore acting with maximum efficiency on the post.

The provision of the nut 44 to carry the spring 46 enables fine adjustment of the position of the spring relative to the rod 34 and accordingly permits variations in the height between the ceiling and the floor of a room to be allowed for.

The rear face of the flange portion 18 of each pelmet conveniently incorporates a curtain rail 54 whereby curtains can be suspended therefrom to surround the bed.

If a bed to be converted is to stand centrally of a room, the above-described basic kit will be supplemented with a fourth pelmet to extend across the top of the bed which will replace the bar 49.

If a bed to be converted is to stand in the corner of a room, it will only be necessary to use two pelmets, one running parallel with the outer side of the bed and the other running parallel with the bottom of the bed, in combination with three brackets and associated posts.

The posts and pelmets of a kit can be made up in sizes to suit the established range of divan bed sizes and ceiling heights up to, say, ten feet.

Posts incorporating metal reinforcements within an outer sleeve of wood or wood composite material such as wood fibre board are preferred to all-wood posts because of the additional strength thereof and because the former constructions do not suffer distortion or compression from the downward spring action thereon. As mentioned above, the provision of an outer wood or wood composite casing enables the posts to be finished in varying cross-sectional shapes and in any one of a number of different colours such as natural, walnut, mahogany or the like; alternatively the posts could be of painted finish. Further, the all-wood upper extent 8 of the post enables a post to be cut to suit a particular room, while the bore in said extent may be of circular transverse section rather than square.

The pelmets may incorporate mouldings 56 to enhance their appearance.

A kit may of course include many removable ancilliary components such as an end-rail 58 for extending between the laterally opposed pair of bottom posts 2, a headboard 60, side tables, lightfittings and the like all for screwing to or supporting on the corner posts as and where required. Other additions will be apparent to those skilled in the art.

Thus it will be appreciated that a kit according to the invention enables a standard bed, typically a divan bed, to be converted to a four-poster at relatively small cost compared with the outlay associated with established four-posters. The number of extras can be added if and when desired, while assembly is well within the capabilities of the average do-it-yourself enthusiast. The posts and accessories are easily removed individually to facilitate cleaning and to provide ready access to the bed, whilst the converted bed has all the characteristics and advantages of an established four-poster.

What I claim and desire to secure by Letters Patent is:

1. A kit of parts for converting a bed in a bedroom into a four-poster, the kit of parts comprising at least three pelmets for securing to the ceiling of the bedroom, one to extend substantially above and the length of each side of the bed and one to extend substantially above and across the bottom end of the bed, four corner posts, one for each corner of the bed and each of a length just less than the height of the bedroom, and four brackets each including a first portion for securing relative to the ceiling of the bedroom substantially above a corner of the bed, a second portion pivotal relative to said first portion and adapted to receive thereon the upper end of an associated corner post, and resilient means reacting between said bracket and the upper end of the associated corner post to urge the lower end of said post towards the floor of the bedroom.

2. A kit of parts as claimed in claim 1 in which the second portion of each bracket comprises a top plate and a rod portion fixed to, to extend downwardly from said plate, and in which the upper extent of each corner post has formed therein an axial bore into which the rod portion of the associated bracket can be received.

3. A kit of parts as claimed in claim 2 in which the second portion of each bracket is pivotal relative to the first portion about a substantially horizontal axis extending transversely of the bed.

4. A kit of parts as claimed in claim 3 in which the resilient means comprise a coil spring surrounding the rod portion, the upper end of said spring being capable of being fixed relative to the rod portion and the lower end of the spring being adapted for abutment by the upper end of the associated corner post.

5. A kit of parts as claimed in claim 4 in which the rod portion is externally threaded, a correspondingly threaded nut being mounted on said rod portion, the upper end of the coil spring being attached to said nut, an annular plate being mounted on the lower end of the spring for abutment against the upper end of the associated corner post.

6. A kit of parts as claimed in claim 1 in which each corner post comprises a central metal tube and an outer wooden sleeve surrounding said tube, the metal tube terminating short of the upper extent of the post.

7. A method of converting a bed in a bedroom having ceiling and a floor into a four-poster by means of a kit of parts containing pelmets, corner posts, and brackets, said method comprising the steps of:

securing the pelmets to the ceiling to extend parallel with, substantially above the associated sides and end of the bed;

securing a first portion of the bracket relative to the ceiling substantially above a corner of the bed, said bracket having a second portion pivotal relative to said first portion containing resilient means; for each corner post in turn:

locating the upper end of the post on the second portion of the associated bracket with said second portion of the bracket pivoted relative to the first portion in a direction along the length of the bed whereby the corner post and second portion of the bracket make an angle with the vertical;

pushing the corner post upwardly against the resilient means and pivoting the corner post and second portion of the bracket together into a vertical position;

releasing the corner post so that the resilient means urges the lower end of the post into contact with the floor whilst the upper end of the post remains in engagement with the bracket.

* * * * *